United States Patent [19]

Gilbert

[11] Patent Number: 4,974,481

[45] Date of Patent: Dec. 4, 1990

[54] TUNING MACHINE WITH REDUCED BACKLASH AND END PLAY

[76] Inventor: John M. Gilbert, 1485 La Honda Rd., Woodside, Calif. 94062

[21] Appl. No.: 440,063

[22] Filed: Nov. 22, 1989

[51] Int. Cl.[5] ..... G10D 3/14

[52] U.S. Cl. ..... 84/306

[58] Field of Search ..... 84/204, 304–306

[56] References Cited

U.S. PATENT DOCUMENTS

| | | | |
|---|---|---|---|
| 310,590 | 1/1885 | Hyde | 84/306 |
| 358,764 | 3/1887 | White | 84/306 |
| 682,925 | 9/1901 | Gerecke | 84/306 |
| 3,496,825 | 2/1970 | Wustl | 84/306 |

*Primary Examiner*—Lawrence R. Franklin

*Attorney, Agent, or Firm*—Paul Hentzel

[57] ABSTRACT

A tuning machine is provided with an adjustable bearing surface for eliminating mesh backlash and end play which gradually develope between the worm and worm gear over years of service. The worm is held against the worm gear by a pair of saddle bearings formed on a sliding retainer. When the bearing wear develops an unacceptable backlash or end play develops, the retainer is loosened and repositioned closer to the worm. In the new position the worm is returned to its original intimate engagement with the worm gear. Simultaneously, the worm, is axially centered due to opposed bevel surfaces on the worm and saddle bearings. The new worm to worm gear mesh is free of backlash and endplay.

25 Claims, 5 Drawing Sheets

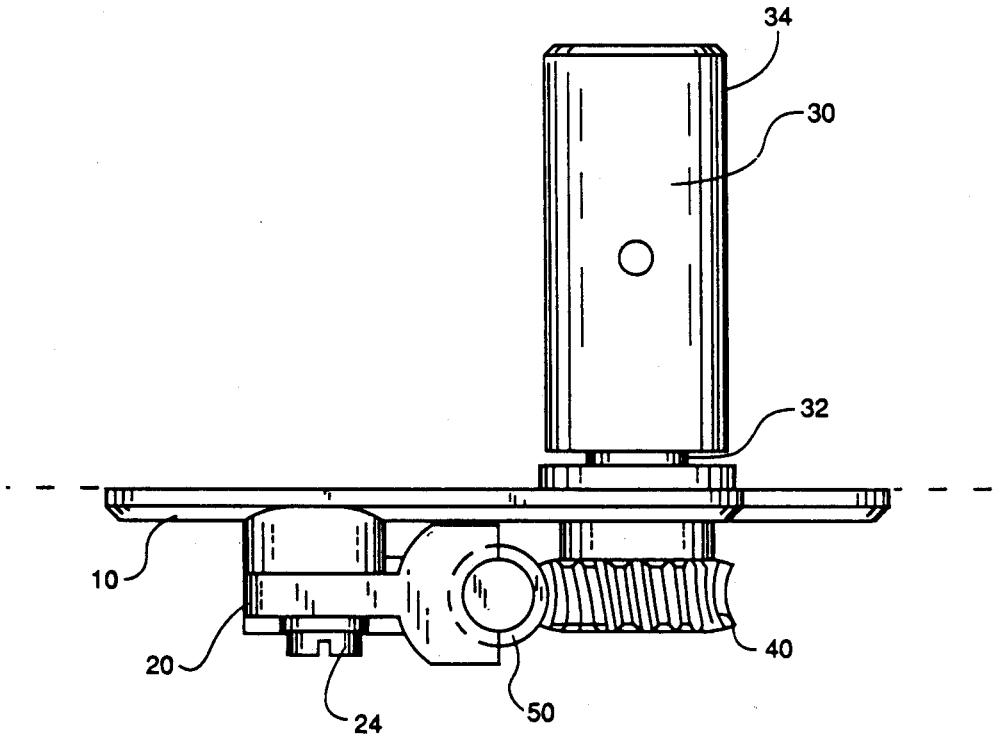
FIG. 1-B
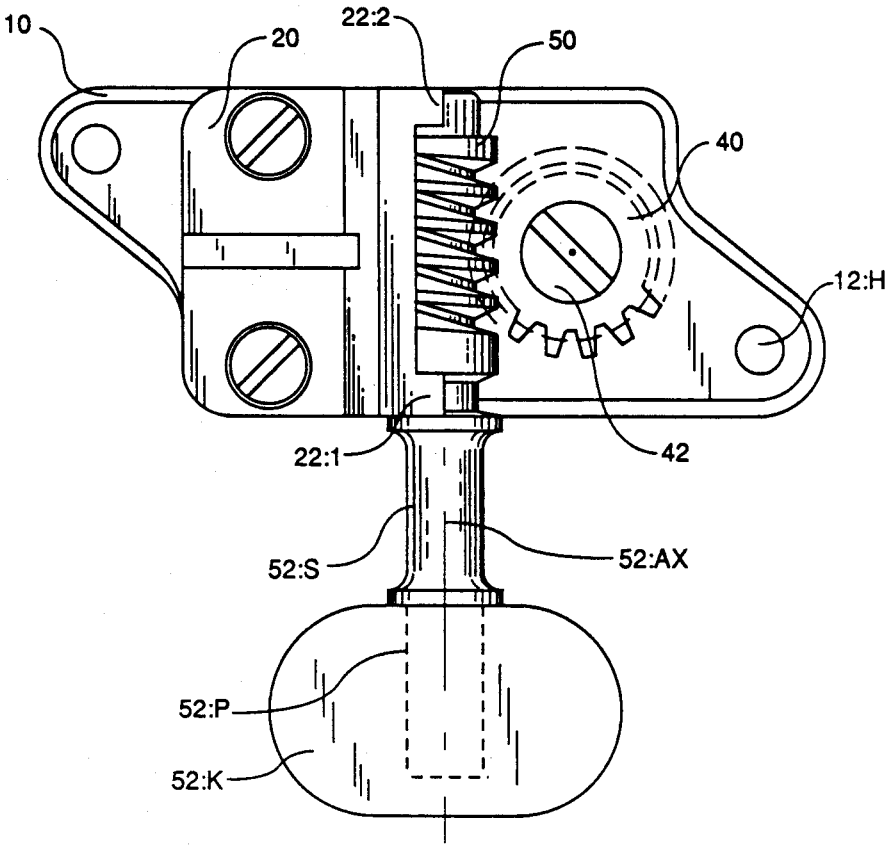
FIG. 1-A

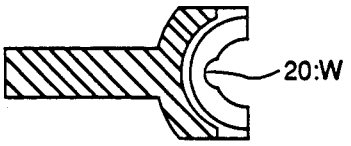
FIG. 3-D
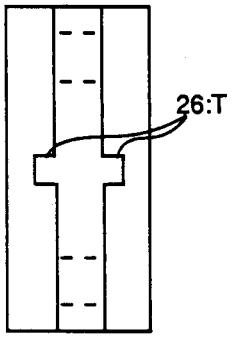
FIG. 3-B
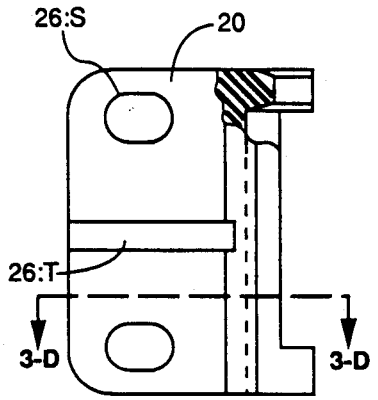
FIG. 3-A
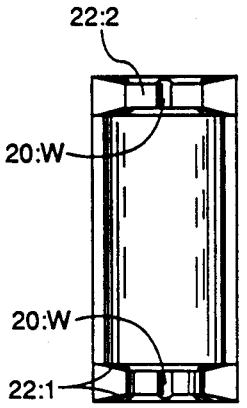
FIG. 3-C
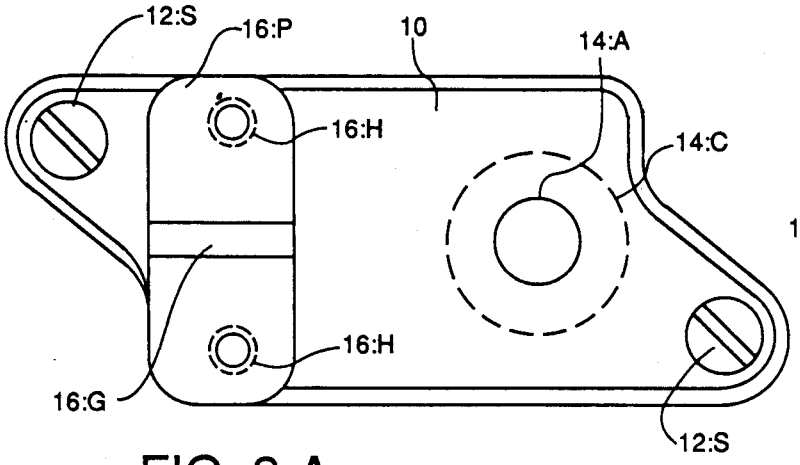
FIG. 2-A
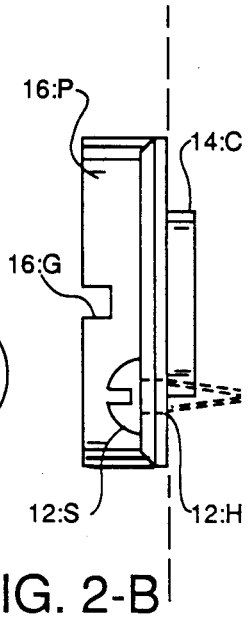
FIG. 2-B

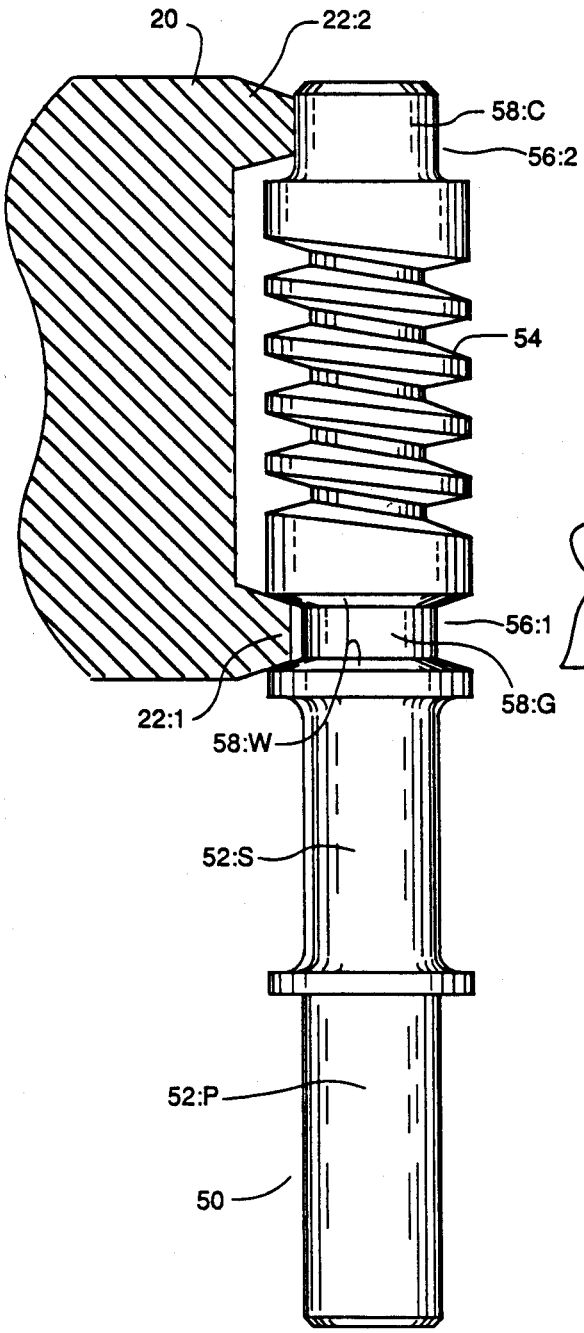
FIG. 4-A
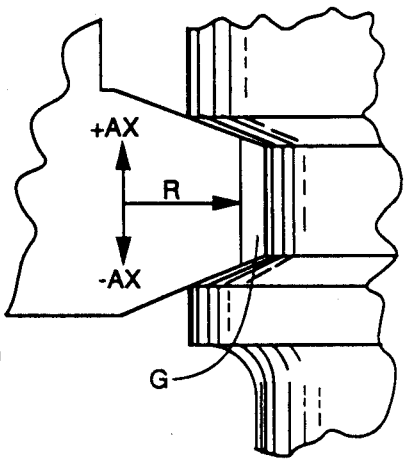
FIG. 4-B

TUNING MACHINE WITH REDUCED BACKLASH AND END PLAY

TECHNICAL FIELD

This invention relates to tuning machines for stringed instruments, and more particularly to tuning machines having a sliding worm retainer that is periodically adjustable for reducing backlash and end play.

BACKGROUND

Heretofore backlash was reduced in tuning machines by forcing the worm laterally into full mesh engagement with the worm gear. U.S. Pat. No. 3,564,573 issued on Feb. 16, 1971 to Wustl, shows a worm spring urging the worm screw tightly against the worm gear. End play was reduced by trapping the worm axially between two stop structures.

Heretofore end play was reduced in tuning machines by forcing the worm axially against a stop to prevent axial displacement during operation. U.S. Pat. No. 4,098,163 issued on July 4, 1978 to Kato, shows an adjustable axial sleeve mounted around the worm shaft. The sleeve is threaded and is positioned to pin the worm shaft against the housing. Axial movement (end play) is prevented by the housing at one end of the worm shaft and by the sleeve at the other end. These prior art devices do not permit the simultaneous reduction of both backlash and end play with a single adjustment.

SUMMARY

It is therefore an object of this invention to provide an improved tuning machine for stringed instruments.

It is another object of this invention to provide such a tuning machine in which a single repositioning of the worm elements simultaneously reduces backlash and end play in the mesh between the worm and the worm gear mesh.

It is a further object of this invention to provide such a tuning machine which may be periodically adjusted to remove backlash and endplay introduced by microscopic wear along the bearing interface.

It is a further object of this invention to provide such a tuning machine in which the wear surfaces along the bearing interface are replaced with new surfaces by reversing the relationship of the bearing elements.

It is a further object of this invention to provide such a tuning machine in which the repositioning motion is stabilized.

It is a further object of this invention to provide such a tuning machine which is easy to assemble and to disassemble.

It is a further object of this invention to provide such a tuning machine in which the bearing elements are lubricated.

It is a further object of this invention to provide such a tuning machine in which the shaft bearing for the string roller is in intimate contact with a locating hole in the mounting plate.

Briefly, these and other objects of the present invention are accomplished by providing a tuning machine for a stringed instrument. The tuning machine has a mounting plate for securing the tuning machine to a stringed instrument, and a string roller mounted on the plate for taking up string when turned in one direction and for letting out string when turned in the other direction. The tuning machine also has a worm gear mounted on the string roller with a worm in engagement with the worm gear. The worm has a shaft portion rotatable about an axis and a screw portion for causing the worm gear and the string roller to turn when the shaft portion is rotated. A worm retainer rotatably engages the shaft portion, and is slideably mounted on the plate for retaining the screw portion in engagement with the worm gear. The engagement simultaneously reduces lateral backlash and axial end play between the worm and the worm gear. A bearing between the worm retainer and the worm has a lateral component of force for reducing the lateral backlash and has an axial component of force for reducing the axial end play. A releasable lock releases and locks the worm retainer in engagement with the worm.

BRIEF DESCRIPTION OF THE DRAWING

Further objects and advantages of the tuning machine and the periodic adjustment of a sliding retainer will become apparent from the following detailed description and drawing in which:

FIG. 1A is a top view of a tuning machine;

FIG. 1B is a side view of the tuning machine of FIG. 1A showing a saddle bearing interface;

FIG. 2A is a plan view of the mounting plate of FIG. 1A showing the pedestal and stabilizing groove;

FIG. 2B is a side view of the mounting plate of FIG. 2A;

FIG. 3A is a side view of the sliding retainer of FIG. 1A;

FIG. 3B is a back view of the sliding retainer of FIG. 3A;

FIG. 3C is a front view of the sliding retainer of FIG. 3A;

FIG. 3D is a sectional view of FIG. 3A;

FIG. 4A is an enlarged plan view of the worm of FIG. 1A showing the screw portion and saddle trunions and a wear gap;

FIG. 4B is a fragmentary blowup of the wear gap and bearing interface of FIG. 4A.

GENERAL DESCRIPTION (FIGS. 1A and 1B)

Figure 5:
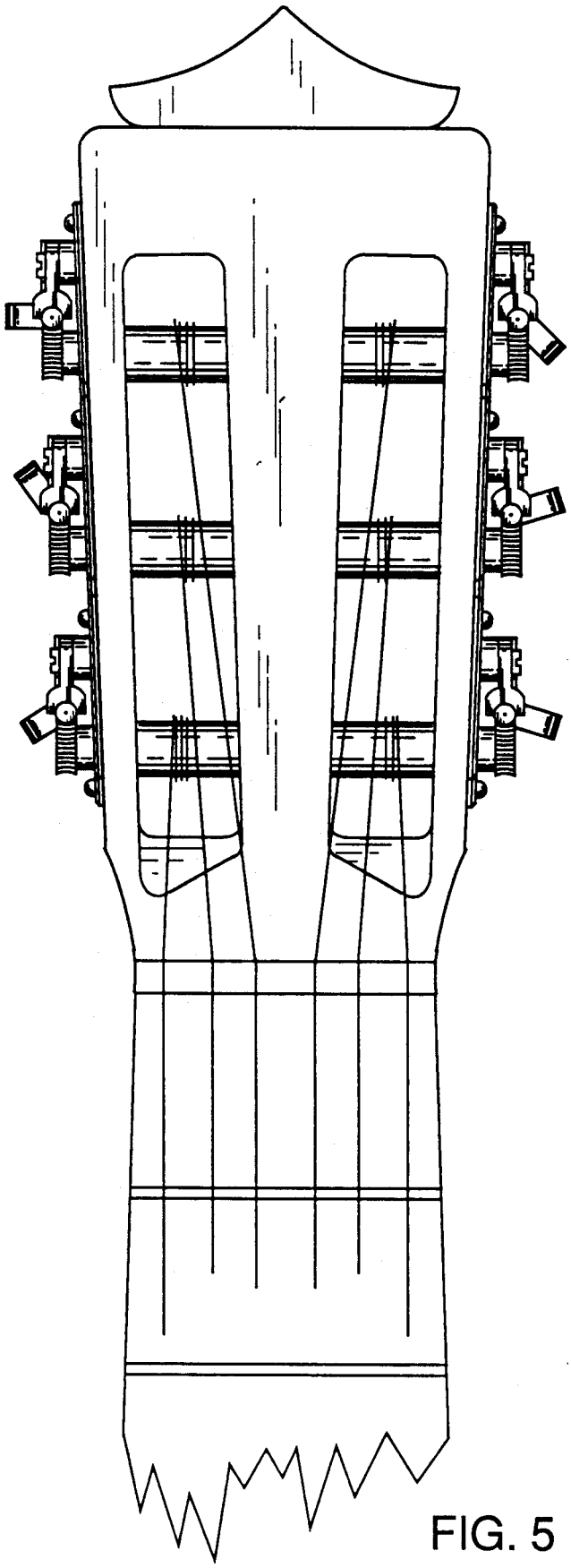
FIG. 5 is a plan view of an instrument with left and right tuning assemblies with multi tuning machines.

The tuning machine of FIG. 1 includes mounting plate 10 for securing the machine to the instrument (shown in dashed lines), string roller 30 and worm gear 40, rotating worm 50 for turning the string roller, and sliding retainer 20 for holding the worm into engagement with the worm gear. The sliding retainer bears against the worm along first bearing interface 22:1 at one end of the worm screw and second bearing interface 22:2 at the other end of the worm screw. As the bearing surfaces slowly wear over years of service, the sliding retainer may be periodically loosened from the mounting plate and pushed forward to a new position slightly closer to the worm. The pushing force simultaneously applies both a lateral force and an axial force to the worm at the bearing interfaces for removing both the backlash and end play in the worm to worm gear mesh.

MOUNTING PLATE 10 (FIGS. 2A and 2B)

The mounting plate is secured to the head of the stringed instrument by a suitable fastening device such as mounting screws 12:S which pass through mounting holes 12:H in the plate for engaging the head material (shown in dashed lines). Thrust collar 14:C extends from the back of the mounting plate into the head material for anchoring the plate against the combined tension in the strings of the instrument. The anchoring by the thrust collar provides stress relief for the mounting screws. In addition, the thrust collar prevents the string roller from rubbing against the bore through the instrument material. The string roller maintains intimate contact with the thrust collar at roller bearing aperture 14:A.

The mounting plate has a stationary pedestal 16:P for raising the sliding retainer in relation to the worm. A suitable stabilizing structure is provided between the stationary pedestal and the sliding retainer for defining the direction of the slide movement and for maintaining a linear slide movement in a straight line. Stabilizing groove 16:G formed in the top of the pedestal engages a corresponding stabilizing tongue 26:T extending from the bottom of the sliding retainer (see FIG. 3). The tongue is guided by the groove for directing the motion of the retainer towards the worm in a straight line.

SLIDING RETAINER 20 (FIGS. 3A, 3B, 3C, and 3D)

Sliding retainer 20 is secured to pedestal 16:P in the retaining position by a suitable securing device such as adjusting or locking screws 24 (shown in FIGS. 1A and 1B). The locking screws pass through slide slots 26:S in the retainer and engage threaded holes 16:H in the pedestal (shown in FIG. 2A). The retainer may be repositioned periodically to adjust for wear of the bearing surfaces along the bearing interfaces. Locking screws 24 are loosened and the retainer pushed toward the worm to re-establish full engagement between the worm and the worm gear. In order to change a worm or worm gear, screws 24 may be removed and the retainer lifted away.

Sliding retainer has a pair of suitable trunions or bearing surfaces such as a first saddle trunion 22:1 and a second saddle trunion 22:2 spaced from the first trunion. The trunions project from the front of the retainer for engaging the worm along shaft portions 56:1 and 56:2 (shown in FIG. 4A).

STRING ROLLER 30-WORM GEAR 40 (FIGS. 1A and 1B)

String roller 30 has a neck end 32 which passes through roller aperture 14:A in the mounting plate from the back or head side. Worm gear 40 is fastened to the neck end of the roller by a suitable device such as end screw 42. The worm gear is held in mesh with the worm by the sliding retainer. The worm bearing surfaces may be lubricated by a suitable lubricating means such as lubricant well 20:W formed in the saddle bearing surface of each trunion.

Shank 52:S of the worm terminates in bonding pin 52:P for receiving a suitable turning device such as manual tuning key 52:K. Turning the key rotates the worm about worm axis 52:Ax causing the worm gear and the string roller to turn.

The string roller has a winding end 34 which extends through the head of the instrument. The string of the musical instrument is wound onto the winding end. The string is "tuned up" or tightened when the tuning key is turned in one direction causing the roller to take up more string. The string is "tuned down" or loosened when the tuning key is turned in the other direction causing the roller to let out some string.

WORM 50 (FIGS. 4A and 4B)

Worm 50 includes screw portion 54 formed on the worm shaft between first shaft portion 56:1 and second shaft portion 56:2. The first shaft portion has an annular V shaped centering groove or channel 58:G therearound with beveled side walls 58:W for receiving the first trunion of the sliding retainer. The sides of the first trunion are correspondingly beveled and bear against the channel side walls. The second shaft portion is a cylinder for bearing against the second trunion of the sliding retainer. The bearing pressure between the worm and the trunions results in lateral and axial force components which reduce the backlash and end play in the worm to worm gear mesh.

The initial contact between the channel sidewalls and the first trunion centers the worm axially in relation to the trunion. After centering, the first trunion and the sidewalls are in full engagement and the worm is prevented from shifting axially (no end play). The full engagement produces offsetting axial force components +Ax and −Ax (shown in FIG. 4B) which eliminate end play. The full engagement also produces a first lateral force component R which pushes the worm in engagement with the worm gear. A second trunion engages the surface of bearing cylinder 58:C on the second shaft portion and produces a second lateral force spaced from the first lateral force. The two lateral forces push the worm into intimate engagement with the worm gear (no backlash).

PERIODIC ADJUSTMENT—WEAR GAP G (FIGS. 4A and 4B)

Preferably, the trunions are made of a softer material than the shaft portions and take most of the bearing wear as the worm is rotated for tuning. The tip of the first trunion does not extend to the floor of the centering channel. A wear gap G between tip and floor provides for bearing surface wear.

Over long periods of service, the bearing surfaces show microscopic wear. The sides of the first trunion wear against the sidewalls of the channel and the tip of the second trunion wears against the bearing cylinder. This slow wear gradually introduces tiny amounts of backlash and end play in the worm to worm gear mesh which can drastically interfere with proper tuning of the strings. Periodically the retainer is repositioned forward to reestablish an intimate meshing. Each forward adjustment of the retainer closes the wear gap slightly because the tip of the first trunion does not wear against the floor of the centering channel.

REVERSIBLE RETAINER 20 (FIG. 3)

In the embodiment of FIGS. 1 through 3 the saddle trunions are identical having the same length, bevel angle and width at the tip. The diameter of the centering channel is slightly less than the diameter of the bearing cylinder to provide the wear gap. After many adjustments of the retainer the wear gap may approach zero. The retainer may be reversed thereby bringing unused wear surfaces into use. Back-to-back stabilizing tongues 26:T are provided on opposite sides of the sliding retainer to permit reverse mounting of the retainer.

SPECIFIC EMBODIMENT

The following particulars of a tuning machine are given as an illustrative example.

String Roller 30—plastic

Worm Gear 40—brass or bronze
Worm 50—steel
Channel 58:G—0.156 inches (0.396 cm) diameter; 30 degree included angle; width at bottom 0.050 inches (0.127 cm)
Bearing Cylinder 58:C—0.171 inches (0.434 cm) diameter
Sliding Retainer 20 plastic
Trunions 22—0.170 inches (0.432 cm) diameter; tip width 0.068 mils (0.173 cm); 30 degree included angle The values, dimensions, and material given above are not intended as defining the limitations of the invention. Numerous other applications and configurations are possible.

INDUSTRIAL APPLICABILITY

It will be apparent to those skilled in the art that the objects of this invention have been achieved by providing a worm retainer which simultaneously reduces backlash and end play in the mesh between the worm and the worm gear mesh. The worm retainer may be periodically adjusted to remove backlash and end play introduced by microscopic wear along the bearing interface. The wear surfaces along the bearing interface may be replaced with new surfaces by reversing the relationship of the bearing elements. The worm retainer has a tongue and groove interface with the mounting plate for stabilizing the repositioning displacement of the retainer. The tuning machine is easy to assemble and to disassemble by removing the worm retainer. A lubrication well is provided along the bearing elements for lubricating the interface.

CONCLUSION

Clearly various changes may be made in the structure and embodiments shown herein without departing from the concept of the invention. Further, features of the embodiments shown in the various Figures may be employed with the embodiments of the other Figures.

Therefore, the scope of the invention is to be determined by the terminology of the following claims and the legal equivalents thereof.

I claim as my invention:

1. A tuning machine for a stringed instrument, comprising:

mounting plate for securing the tuning machine to stringed instrument;

string roller means mounted on the mounting plate for taking up string when turned in one direction and for letting out string when turned in the other direction;

worm gear mounted on the string roller means;

worm means having a shaft portion rotatable about an axis and a screw portion in engagement with the worm gear for causing the worm gear and string roller means to turn when the shaft portion rotates;

worm retaining means for rotatably engaging the shaft portion, and slideably mounted on the mounting plate for retaining the screw portion in engagement with the worm gear and simultaneously reducing lateral backlash and axial end play between the worm means and the worm gear;

bearing means between the worm retaining means and the worm means having a lateral component of force for reducing the lateral backlash and having an axial component of force for reducing the axial end play; and releasable locking means for releasing and locking the worm retaining means.

2. The tuning machine of claim 1 wherein the bearing means further comprises:

a first bearing means having a first bearing surface on the worm means and a corresponding first bearing surface on the worm retaining means for engaging the first bearing surface on the worm means; and a second bearing means spaced from the first bearing means, having a second bearing surface on the worm means spaced from the first bearing surface on the worm means, and a corresponding second bearing surface on the worm retaining means for engaging the second bearing surface on the worm means.

3. The tuning machine of claim 2 wherein the first bearing means is formed by a channel means and a first projecting means extending into and captured by the channel means.

4. The tuning machine of claim 3 wherein the channel means has at least one beveled side engaging the first projecting means for providing a lateral component of force and an axial component of force.

5. The tuning machine of claim 3 wherein the side walls of the channel means are beveled and engage the first projecting means for providing a lateral component of force and an axial component of force.

6. The tuning machine of claim 5 wherein the screw portion of the worm means is positioned in the middle of the worm means, and the shaft portion of the worm means has a first shaft portion extending beyond the screw portion at one end thereof and a second shaft portion extending beyond the screw portion at the other end thereof.

7. The tuning machine of claim 6 wherein the first bearing means engages the first shaft portion at the one end of the screw portion, and the second bearing means engages the second shaft portion at the other end of the screw portion.

8. The tuning machine of claim 7 wherein the channel means is the first bearing surface on the worm means and the projecting means is the first bearing surface on the worm retaining means.

9. The tuning machine of claim 8 wherein the channel means is positioned on the first shaft portion of the worm means.

10. The tuning machine of claim 9 wherein the second bearing surface on the worm means is a cylinder on the second shaft portion which is concentric with the worm axis of rotation, and the second bearing surface on the worm retaining means is a second projecting means.

11. The tuning machine of claim 10, wherein the first projecting means is tapered to engage both side wall of the channel means without touching the bottom of the channel means.

12. The tuning machine of claim 11, wherein the first projecting means is identical to the second projecting means.

13. The tuning machine of claim 12, wherein the diameter of the channel means on the first shaft portion is slightly less than the diameter of the cylinder on the second shaft portion.

14. The tuning machine of claim 13, wherein the projecting means are saddle trunions.

15. The tuning machine of claim 14, wherein the saddle trunions extend 180 degrees around the first shaft portion and the second shaft portion.

16. The tuning machine of claim 14, further comprising a lubricant well formed in the second saddle trunion.

17. The tuning machine of claim 1, further comprising a stabilizer means for defining the direction of slide motion of the worm retaining means and for maintaining the slide motion in a straight line.

18. The tuning machine of claim 17, wherein the stabilizer means is formed between the mounting plate and the worm retaining means.

19. The tuning machine of claim 18, wherein the stabilizing means is a tongue-in-groove interface between the mounting plate and the worm retaining means.

20. The tuning machine of claim 19, wherein the tongue is formed on the worm retaining means and the groove is formed in the mounting plate.

21. The tuning machine of claim 20, further comprising a raised pad on the mounting plate.

22. The tuning machine of claim 21 wherein the releasable locking means comprises, locking holes through the raised pad in the mounting plate and locking screws extending through the locking holes for securing the worm retaining means.

23. The tuning machine of claim 22 wherein the releasable locking means further comprising, elongated holes through the raised pad in the mounting plate for permitting the retaining means to be repositioned when released.

24. The tuning machine of claim 1 further comprising, a roller bearing surface on the mounting plate for the string roller means.

25. The tuning machine of claim 24 wherein the roller bearing surface comprises, a thrust collar raised from the mounting plate.

* * * * *